US005325628A

United States Patent [19]

Yingling

[11] Patent Number: 5,325,628

[45] Date of Patent: Jul. 5, 1994

[54] AUTOMATIC DOOR OPERATOR

[76] Inventor: Dan C. Yingling, 11020 Yingling La., Frazeysburg, Ohio 43822

[21] Appl. No.: 41,923

[22] Filed: Apr. 2, 1993

Related U.S. Application Data

[63] Continuation of Ser. No. 755,667, Sep. 6, 1991, abandoned.

[51] Int. Cl.[5] ..... E05F 11/00

[52] U.S. Cl. ..... 49/360; 49/118; 49/123; 49/139; 49/410; 49/506

[58] Field of Search ..... 49/360, 118, 123, 370, 49/410, 199, 200, 25, 139, 140, 368, 367, 506

[56] References Cited

U.S. PATENT DOCUMENTS

| | | | |
|---|---|---|---|
| 1,222,136 | 4/1917 | Reynolds | 49/118 X |
| 1,324,587 | 12/1919 | Elliott | 49/360 |
| 1,658,640 | 2/1928 | Huberty | 49/118 X |
| 1,778,360 | 10/1930 | Gorman | 49/139 X |
| 1,913,725 | 6/1933 | Schweig | 49/370 X |
| 2,235,381 | 3/1941 | McCormick | 49/123 X |
| 3,199,858 | 8/1965 | Koblensky | 49/118 |
| 3,344,556 | 10/1967 | Edwards | 49/139 X |
| 3,432,966 | 3/1969 | Bordner | 49/368 |
| 3,438,147 | 4/1969 | Lander | 49/123 X |
| 3,909,980 | 10/1975 | Courtney et al. | 49/139 X |
| 4,050,191 | 9/1977 | Azuma | 49/360 |
| 4,131,830 | 12/1978 | Lee et al. | 49/199 X |
| 4,245,614 | 1/1981 | Hurwitz et al. | 49/410 X |
| 4,304,071 | 12/1981 | Obrecht | 49/370 X |
| 4,475,313 | 10/1984 | Governale | 49/370 |
| 4,635,398 | 1/1987 | Nakamura | 49/370 X |
| 4,750,118 | 6/1988 | Heitschel et al. | 49/25 X |
| 4,905,542 | 3/1990 | Burm et al. | 49/139 X |

*Primary Examiner*—Philip C. Kannan

*Attorney, Agent, or Firm*—Porter, Wright, Morris & Arthur

[57] ABSTRACT

An automatic door operator which works in conjunction with a sliding door(s) and existing track on which the door(s) moves, to open and close the door(s) without manual pushing and pulling. The invention is useful on single-sliding door installations, biparting single-track installations, and biparting overlapping door installations.

6 Claims, 10 Drawing Sheets

AUTOMATIC DOOR OPERATOR

This is a continuation of U.S. patent application Ser. No. 07/755,667, filed Sep. 6, 1991, now abandoned.

BACKGROUND AND SUMMARY OF THE INVENTION

The present invention is concerned generally with the art of door opening and closing devices, and more particularly, an apparatus for automatically opening and closing a sliding door mounted on a structure.

It has been known for many years to open doors, such as garage doors, by initial vertical movement of the door along a track until the door reaches a radius in the track and begins horizontal movement at the top end of the door while the bottom end is still rising vertically. Ultimately, the door is typically opened until the entire door is substantially horizontally disposed, generally parallel with the floor of the garage. Actuation of a garage door along its track is typically accomplished by a small horsepower motorized unit. The motorized units typically drive a flexible member such as a belt along one or more pulleys to lift the door and cause the door to travel along the track. Once opened, the door may be closed by the motorized unit causing the flexible member to operate in a reverse direction, resulting in the door moving down the track and back to a closed position. Ordinarily, the motorized units are secured to the ceiling or to roof trusses of the garage or other structure on which the doors are mounted.

The known motorized units are typically operated by simply being plugged into an electrical outlet. The motorized unit may be caused to turn on by well-known means of a hand-held remote control transmitter which is set to a frequency that matches that of a receiver in the motorized unit. The hand-held remote control transmitter is usually battery powered and operates by simply pushing a button on the hand-held unit while within range of the receiver which starts the motorized unit and opens the door. Pushing the button a second time, after the door is fully opened, will cause the motorized unit to operate in a reverse direction thereby closing the door.

Other devices have been invented for assisting in the opening and closing of large doors. In many cases, the inventions have included a track upon which the door is slidably mounted and a trolley attached to the door that travels on the track.

These known devices have been secured to the outside of the building structure to facilitate installation and operation with a track on which the door(s) is mounted. Tracks are usually mounted on the outside of a building structure doorway. And, these known devices require direct interaction with the track on the building structure. This interaction further limits these devices in that the operator track must substantially match the door track in length which limits the travel of the door(s). These known devices require customization to fit the particular door track on location. The cost of the known devices plus installation costs are twice (or more) as expensive as the present invention. This is at least in part because the present invention does not directly interact with the door track, which eliminates the need for customization to mate with the door track.

The present invention is primarily intended for the operation of opening and closing doors that slide open in a horizontal direction. The present invention is useful in opening and closing sliding doors on barns, warehouses, hangers, and other structures. The present invention may be located inside the building structure so that it is not exposed to weather, vandalism, theft, or other calamity. A remote control transmitter may be used to open and close the door from outside the building structure in a manner like that used in association with typical garage door openers. The present invention works in association with the door track already installed when the door was hung. The present invention is designed to work in conjunction with any track upon which a door slides.

The present invention includes a motorized unit similar to that used on overhead garage door openers. The present invention further comprises a motorized unit that drives a flexible member, such as a chain, which is interconnected through one or more structural members and associated chain engagement means in association with the structural members, and means for changing the direction of the chain to cause the chain to travel in a continuous loop, to open and close the door without need for manual involvement to push or pull the door open and closed. The motorized unit of the present invention may be powered by conventional electrical means. The motorized unit may be adapted for staring and stopping by remote control transmitting and receiving means. The motorized unit drives a set of gears over which the chain or other flexible member passes. The motorized unit is associated with adjustment means for adjusting the amount of travel the chain or other flexible member will undertake when opening or closing a given door. A structural member is mounted to the door, and the means for changing the direction of the chain, such as an idler bracket assembly, is mounted to a portion of the structure on one side of the door opening opposite the side of the door opening where the motorized unit is mounted. The chain or other flexible member is driven by the motorized unit gear drive in a continuous loop fashion, through the door mounted structural member and through the far side wall mounted idler bracket, before returning to the motorized unit. As the chain moves in one direction (ordinarily clockwise or counterclockwise), the door opens, and as the chain moves in the opposite direction, the door closes. The present invention is designed to open and close a single sliding door, biparting single track doors, and biparting overlapping doors.

The present invention will be more thoroughly explained by the following drawings and detailed description.

DESCRIPTION OF PREFERRED EMBODIMENT(S)

Figure 1:
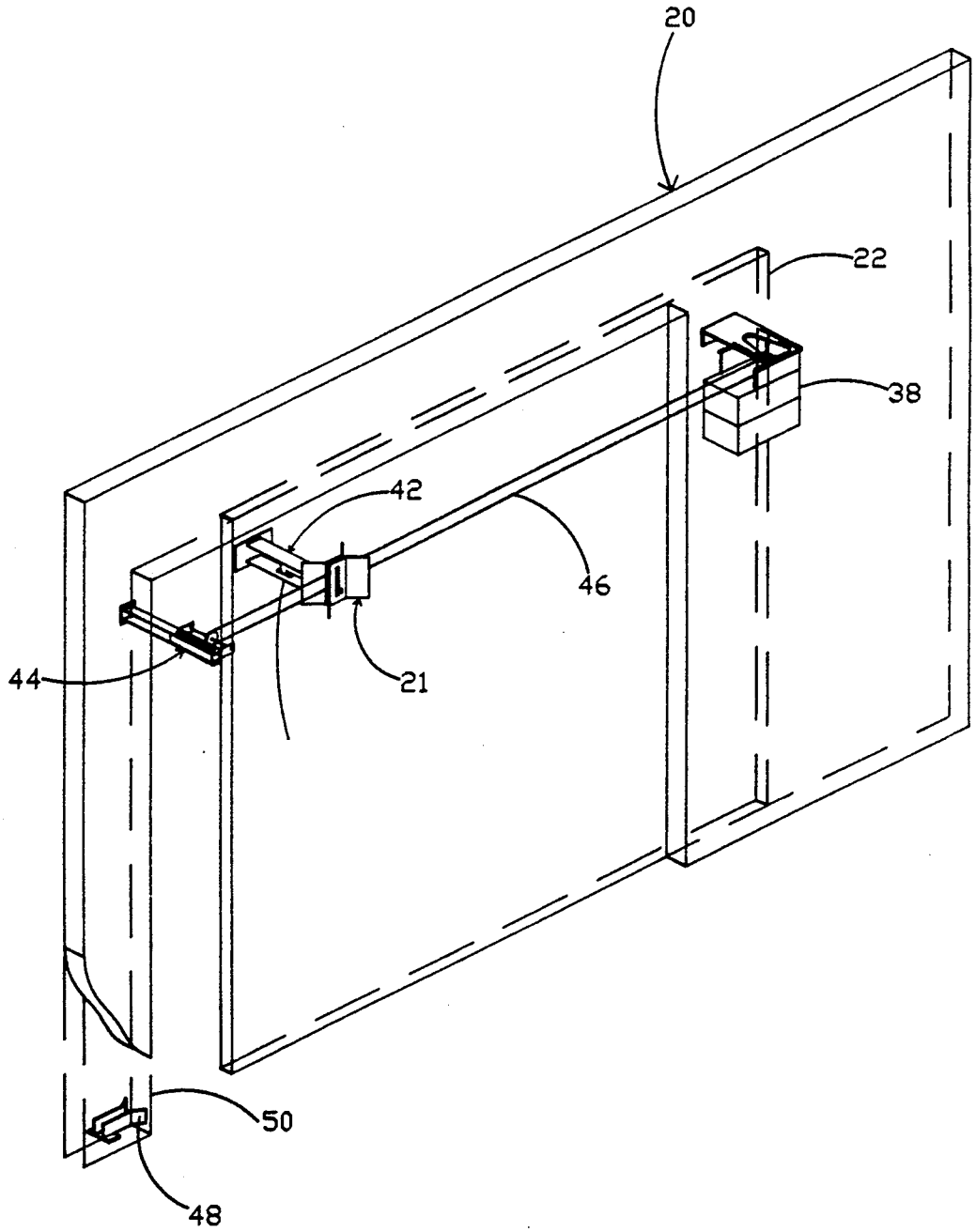
FIG. 1 is a perspective view of the apparatus of the present invention in use with a single sliding door installation.

Referring now to the drawings and particularly FIG. 1, there is illustrated a portion of a building 20 having a door 22 mounted thereto and a door operator assembly 21, for slidably opening and closing access to the building 20. The door 22 is of a type that typically slides along a track, the track being mounted on a portion of the structure. The present invention is designed to work with existing tracks and building structures without need of significantly modifying either the building structure or the track. The present invention adds a unique combination of elements to the door assembly to thereby open the door and close the door without manual pushing and pulling of the door(s).

In a single door assembly, the present invention comprises a motorized unit 38 with a gear drive assembly 40 associated therewith, a door-mounted structural member assembly 42, a far side wall-mounted idler bracket assembly 44, and a flexible member 46 such as a chain. The invention may also include a door guide member 48 secured to a forward edge 50 of a door or doorway support member for receiving a door to assist in alignment of the door(s).

Figure 9:
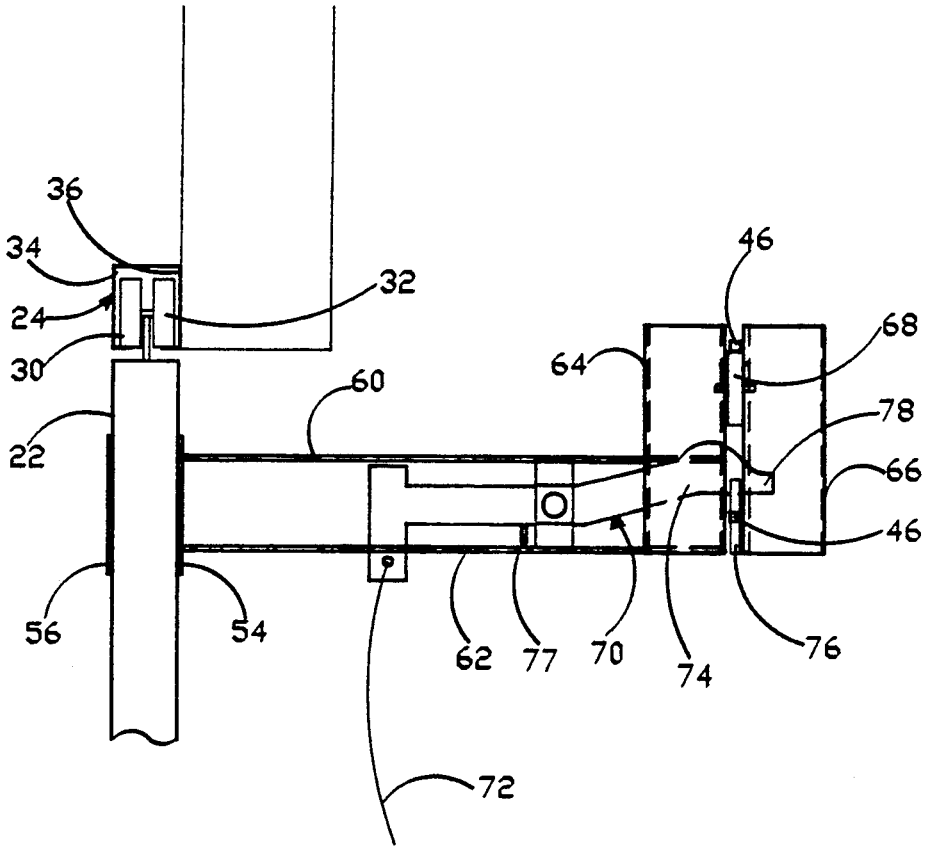
FIG. 9 is a side view of a structural member of the present invention mounted to a door.

One particular door track 24 which is common is shown in FIG. 9. The door track 24 shown in FIGS. 9 is offered only as a typical sliding door track assembly which one may encounter when installing the present invention. A bracket 26 may be mounted on the top edge 28 of the door 22 and wheels or rollers 30, 32 are secured to the top of the bracket 26. The wheels 30, 32 are contained within two face-to-face L-shaped guides 34, 36 and are free to move along these guides 34, 36 as the door is moved. Several other track designs are well known to those of ordinary skill in the art and would work equally well with the present invention.

Figure 10:
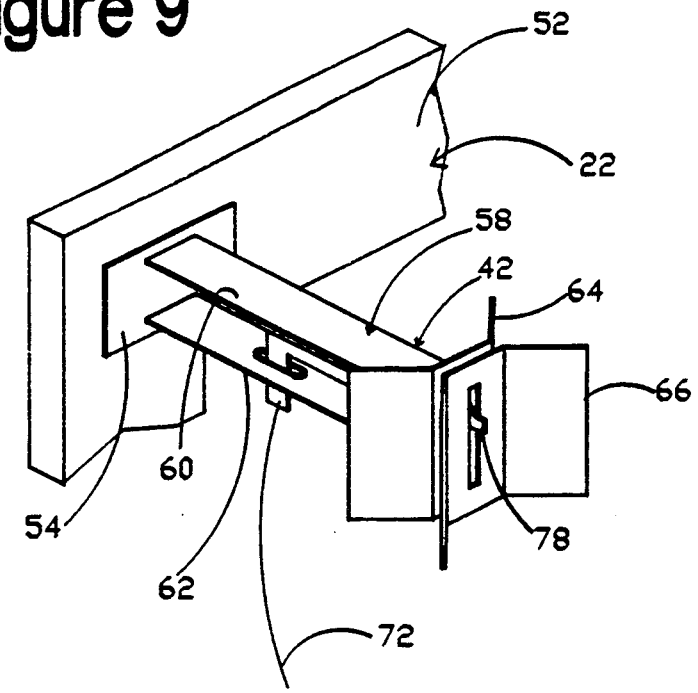
FIG. 10 is a perspective view of a structural member of the present invention mounted to a door.

Referring now to FIG. 10, a structural member 42 is shown secured to a single door 22 and preferrably along the door's upper most frame member 52. The present invention is preferably mounted near the top of the door so that it does not interfere with access through the doorway. The present invention is also preferably mounted on the interior side of the door 22 and building 20 so that it is not exposed to weather, vandalism, and/or theft. The door-mounted structural member 42 may be comprised of two mounting plates 54, 56 that may be secured to the door 22 by screws, bolts, or other known attachment means. Extending from the interior door mounting plate 54 is the body 58 of the structural member 42 which, in this embodiment, is comprised of two steel flanges 60, 62 that are secured to the mounting plate 54. The two flanges 60, 62 extend a distance from the door and have at their ends two flared plates 64, 66 through which the chain or flexible member 46 will pass.

Figure 8:
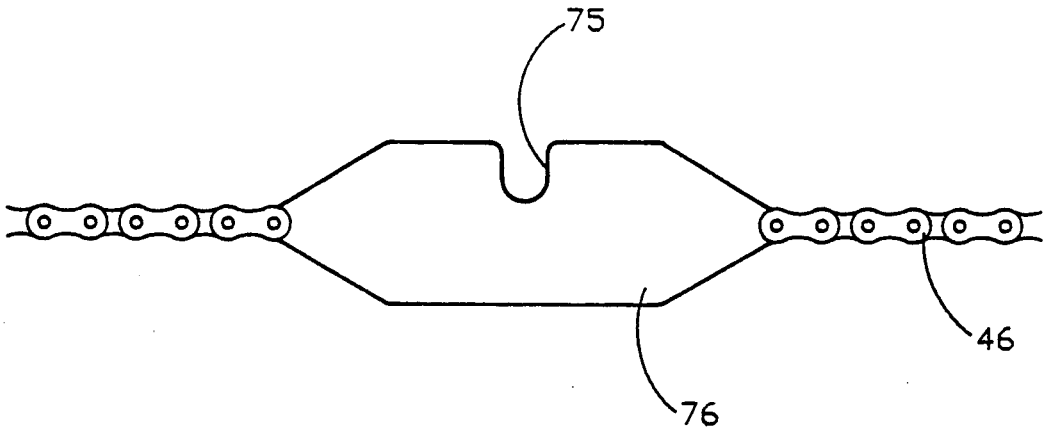
FIG. 8 is a side view of a chain plate of the present invention.

The inner workings of the structural member 42 assembly are best shown in FIG. 9. A roller 68 over which the chain 46 Passes is secured within the flared plates 64, 66. An engagement/disengagement mechanism 70 is provided within the two flanges 60, 62 and causes the chain 46 to become disengaged from the door-mounted structural member assembly 42 by pulling a rope or lever 72 attached to the disengagement mechanism 70. When the rope 72 is pulled, the arm 74 of the mechanism 70 lifts out of engagement with a notch 75 in a chain plate 76 (best shown in FIG. 8) off of a protrusion 78 from the arm 74 which allows the door 22 to be opened or closed manually without chain involvement. This is useful in the event of a power failure which leaves the motorized unit inoperable. The arm 74 of the disengagement mechanism 70 may be designed as a fulcrum about a spring 77. When the arm 74 is engaged within the notch 75 of the chain plate 76, the chain 46 applies force to the structural member 42 whenever the chain moves which causes the door to move since the structural member 42 is secured to the door.

Figure 12:
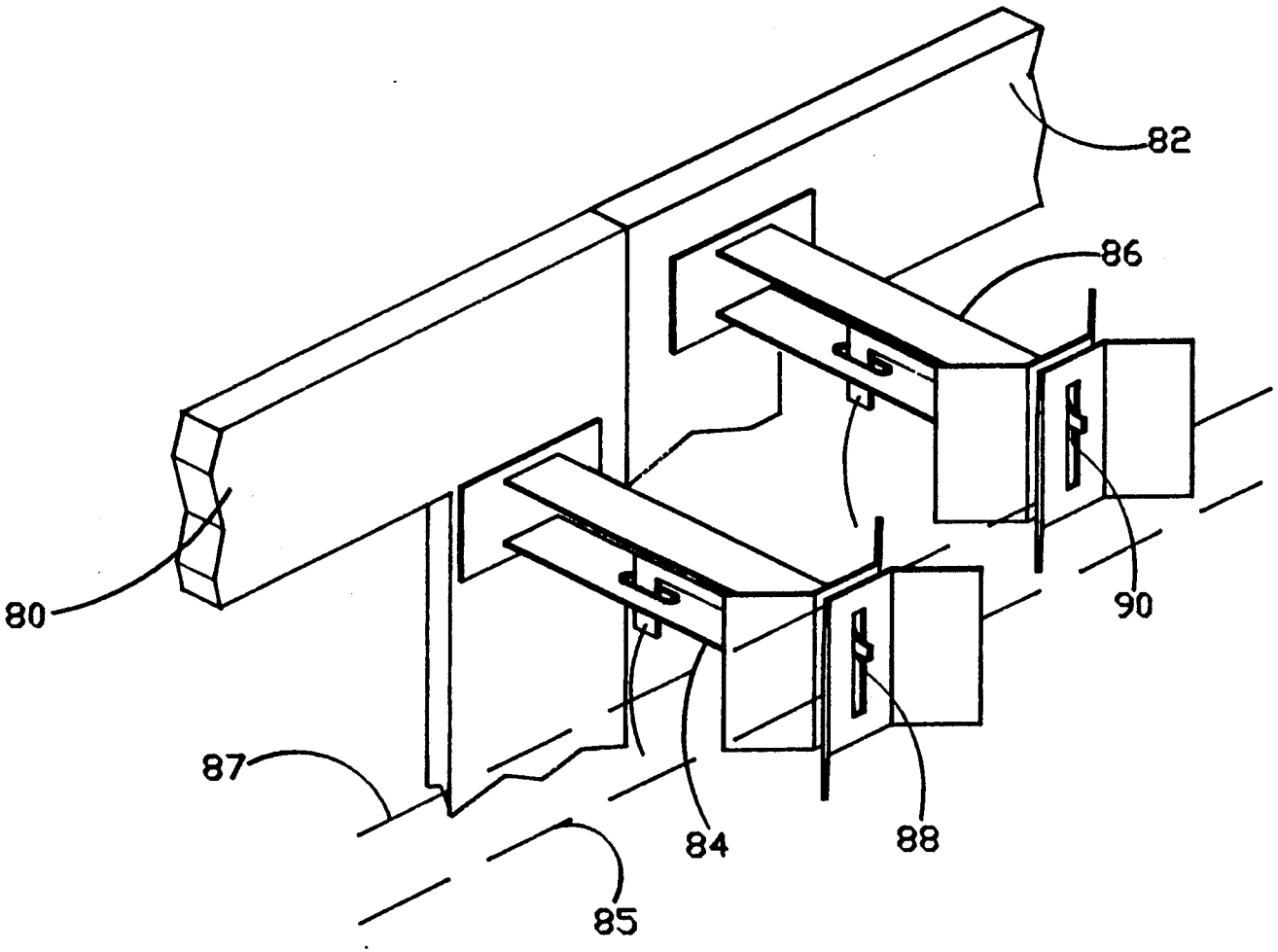
FIG. 12 is a perspective view of two structural members of the present invention each secured to separate ones of two biparting single-track doors.

Referring now to FIG. 12, in another embodiment of the present invention, the door opening apparatus is shown in use with biparting single-track doors 80, 82. In this embodiment, at least one door-mounted structural member 84, 86 is secured to each door. One door-mounted structural member 86 may be positioned slightly higher than the other door-mounted structural member 84 so that the chain 46 will pass through the flared plates at the end of each structural member 84, 86, contacting the chain engagement means 88 of one structural member 84 in its lower portion 85 of a continuous loop and the chain engagement means 90 of the other structural member 86 in its upper portion 87 of the continuous loop. This results in each door 80, 82 moving in opposite directions as the chain 46 moves clockwise or counterclockwise. In other words, when the doors 80, 82 begin in a closed position and movement of the chain 46 is begun, both doors will open as a result of actuation by one chain drive motorized unit. As the chain 46 is moved in the opposite direction, both doors 80, 82 will come to a closed position abutting each other.

Figure 11:
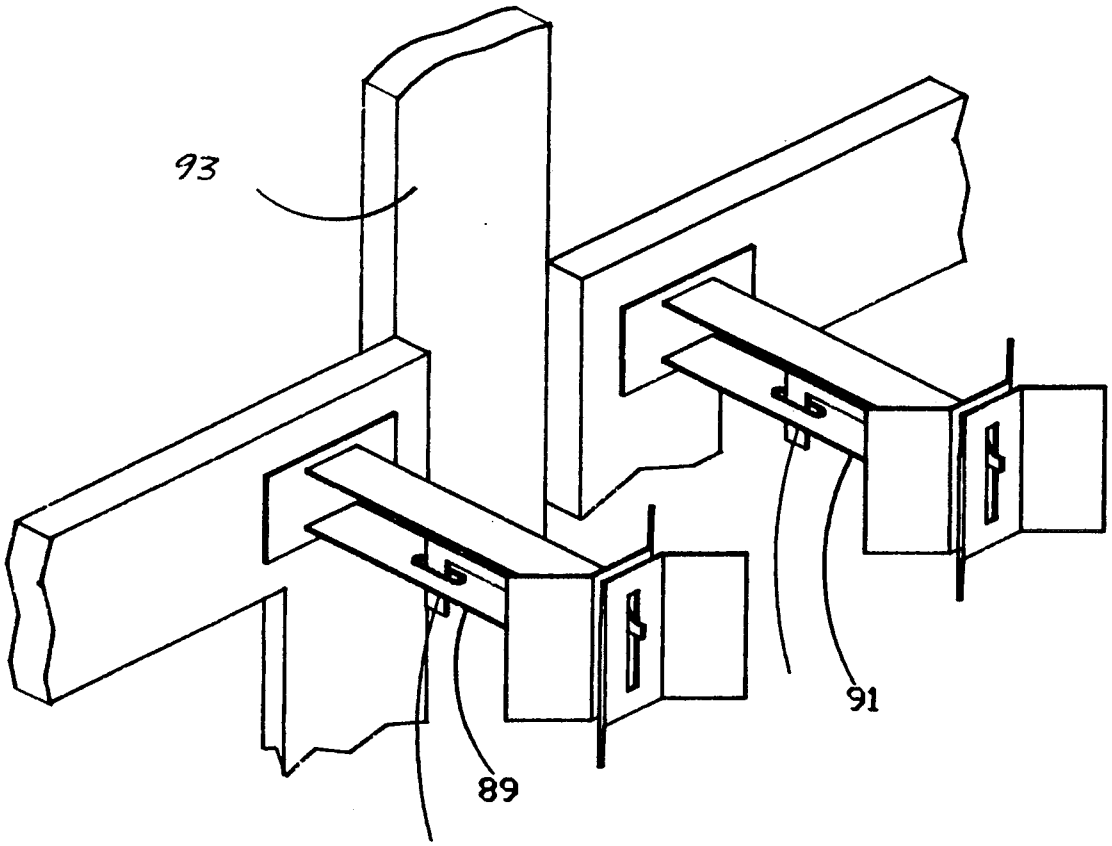
FIG. 11 is a perspective view of two structural members of the present invention, each secured to separate ones of two biparting doors.

FIG. 11 shows an aligned arrangement of two structural members 89, 91 on biparting doors if two motorized units are used (one on each side of doorway) to drive two separate chains (not shown). A center post 93 would be needed in this embodiment to mount two idler brackets, one for each door operator assembly. One idler bracket may also be modified to contain two chain return means so that it would be capable of accommodating two chains to open two doors. The difference between what is shown in FIG. 12 and FIG. 11 is that FIG. 12 uses one motorized chain drive unit to open two door at once, while FIG. 11 is an alternative embodiment for opening two doors with two motorized chain drive units working independently from each other.

Figure 13:
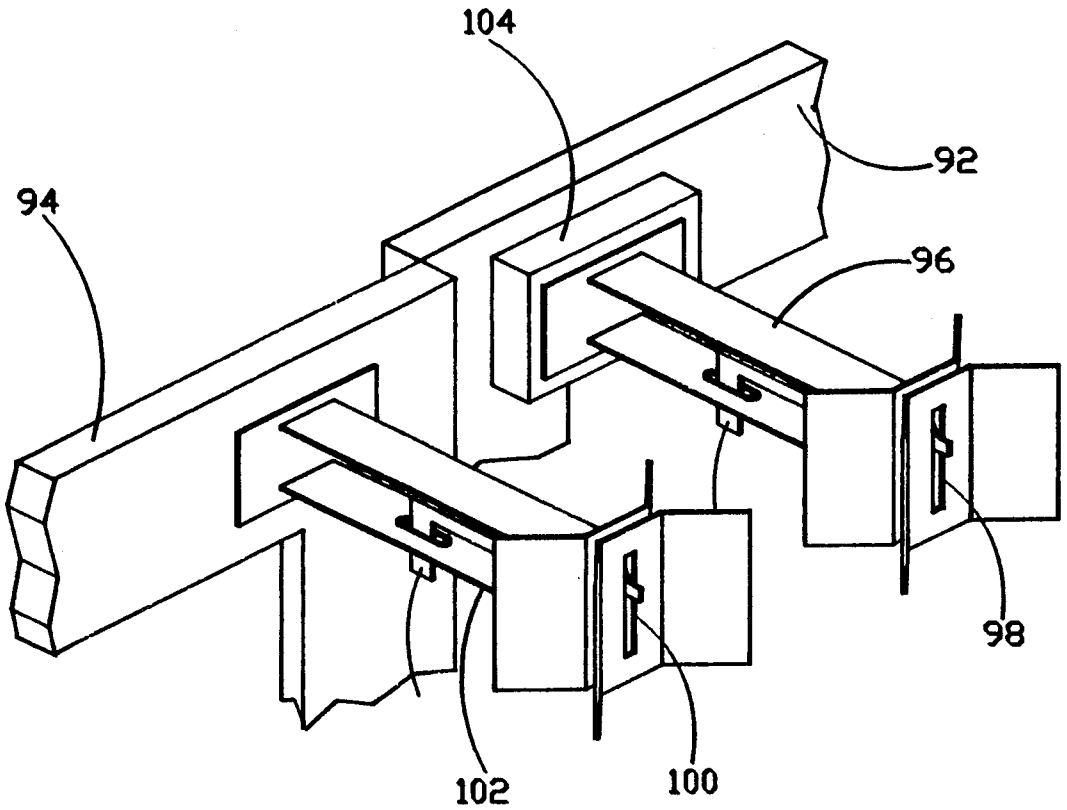
FIG. 13 is a perspective view of two structural members of the present invention each secured to separate ones of two biparting overlapping doors.

Referring to FIG. 13, yet another embodiment of the present invention is illustrated, wherein two biparting overlapping doors 92, 94 may be opened and closed by use of the present invention. This embodiment is similar to the single-track door assembly 21 except the most exterior door 92 requires an extended door-mounted structural member 96 to bring the chain receiving portion 98 of the structural member 96 in alignment with the chain receiving portion 100 of the door-mounted structural member 102 of the interior most door 94. This can be accomplished by adding a spacer block 104 to the interior of the exterior most door 92 or by making the door-mounted structural member 96 longer. The operation of the biparting overlapping doors 92, 94 is then similar in all other respects to that described above.

Figure 4:
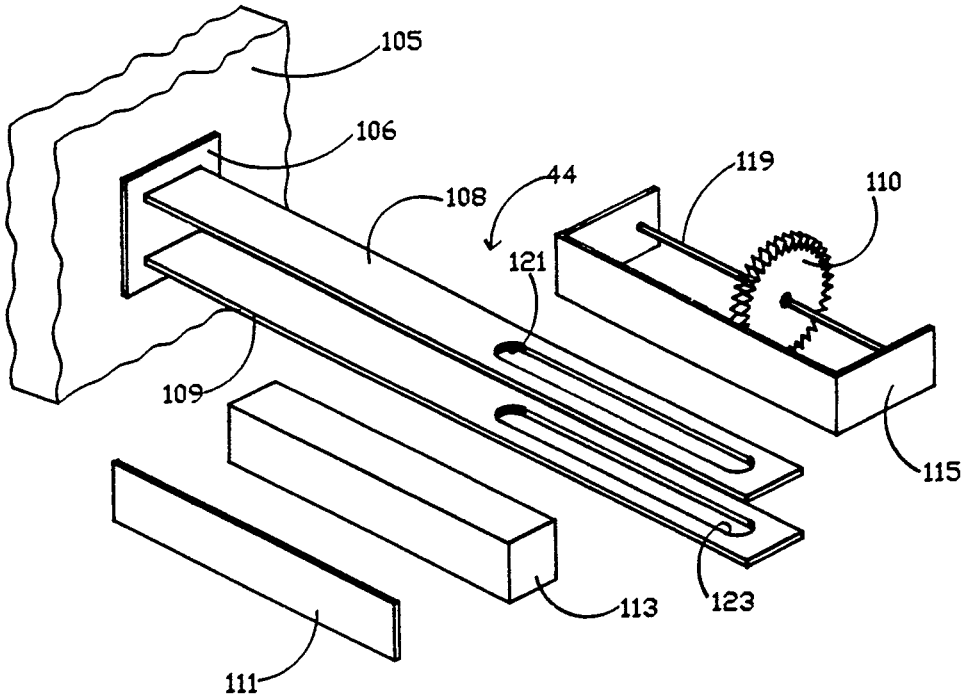
FIG. 4 is a perspective exploded view of an idler bracket assembly of the present invention

Referring now to FIG. 4, the far side, wall-mounted idler bracket assembly 44 is shown. This bracket 44 is fixedly secured to a wall 105 or ceiling member on an opposite side of the doorway from the motorized unit 38. The idler bracket assembly 44 acts as a return point for the chain 46 or flexible member of the present invention. Since the chain 46 forms a continuous loop that begins at the motorized unit 38 and passes through the door-mounted structural members, it must have a point in the assembly where the chain 46 returns to the motorized unit 38. The idler bracket assembly 44 serves to fulfill this need. In a preferred embodiment, a mounting plate 106 is secured to the wall 105 of the structure and two steel flanged members 108, 109 are welded or otherwise secured to the mounting plate 106. A strengthening block 113 is adjustably secured between members 108, 109 and particularly between slotted portions 121, 123 therein Bolts or other known fastening means may be used to secure the block 113 between the members 108, 109. A sprocket assembly 115 is then secured to one side of the block 113 while a fastening plate 111 is secured to the other side of the block 113. Fastening means such as bolts (not shown) can connect the plate 111 to the sprocket assembly 115 through the block 113. The sprocket assembly has an idler wheel 110 which engages the chain 46. The wheel 110 revolves around a rod 119.

Figure 5:
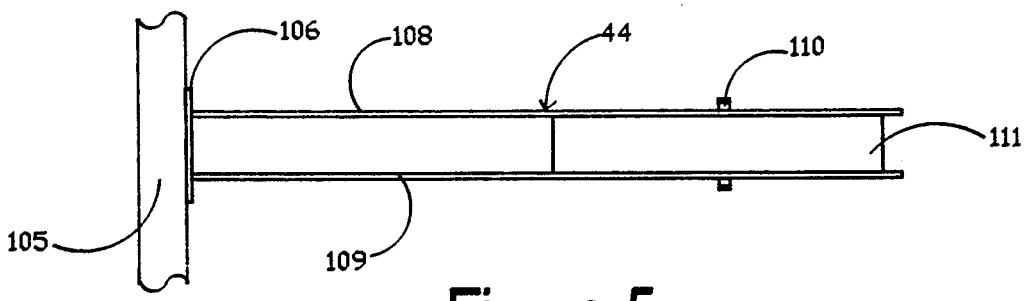
FIG. 5 is a side view of the idler bracket assembly of FIG. 4.

In FIG. 5, a side view of the idler bracket assembly 44 is shown which shows the idler wheel 110 over which the chain 46 rides to return to the motorized unit 38. It would be apparent to one of ordinary skill in the art to arrive at several different designs for the idler bracket assembly 44 and the door-mounted structural member assemblies. The present invention is not to be restricted to the specific designs shown and described in this specification. Several differently designed assemblies having the same or similar function are within the scope of this invention.

Figure 6:
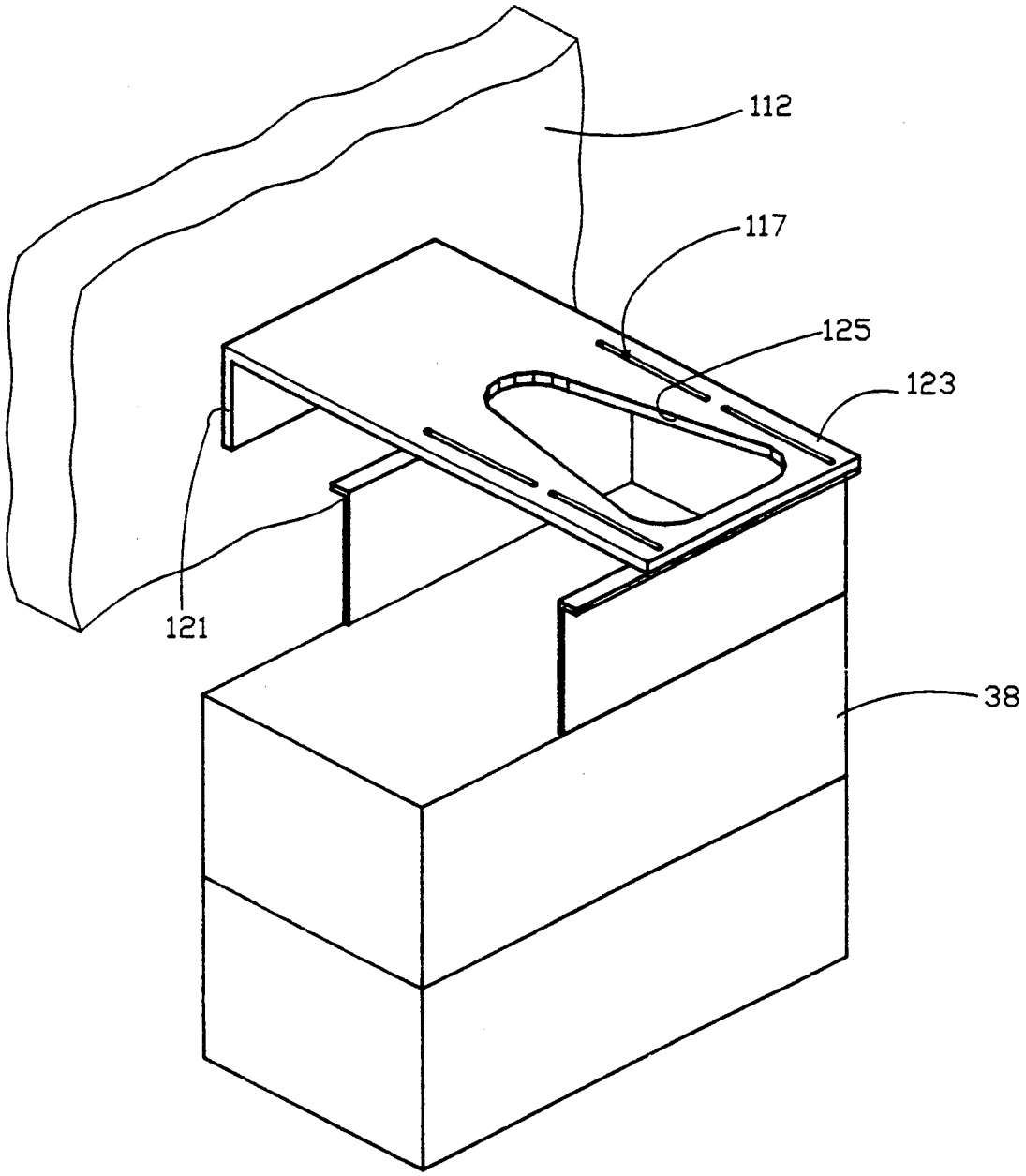
FIG. 6 is a perspective view of a mounting structure for securing the motorized unit of the present invention.

The motorized unit 38 may be mounted as shown in FIG. 6, to the wall 112 of the building structure. A bracket member 117 having a wall mounting depending portion 121 and a laterally extending portion 123 supports the unit 38. A maintenance access opening 125 may be incorporated into the member 117. One of ordinary skill in the art would recognize many different approaches to mounting the motorized unit to the building.

Figure 3:
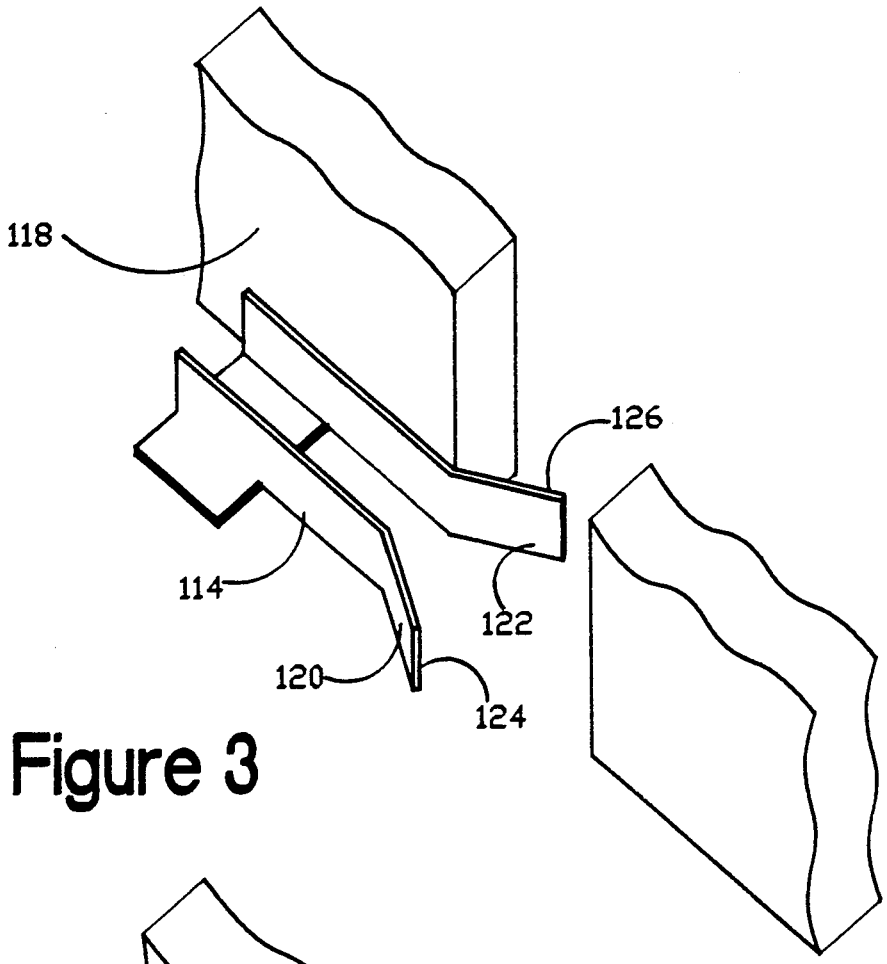
FIG. 3 is a perspective view of a door guide bracket on an overlapping door.
Figure 2:
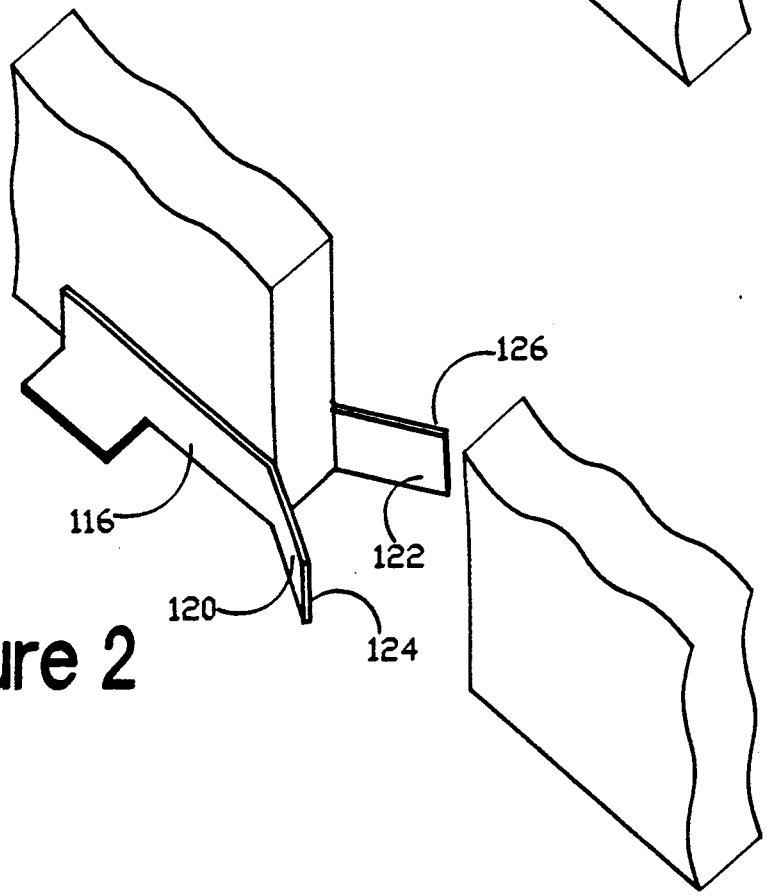
FIG. 2 is a perspective view of a door guide bracket on a biparting single-track door.

FIGS. 2 and 3 show door guide assemblies 114, 116 which may be used with the present invention to guide the doors into proper alignment. On overlapping doors, the door guide assembly 114 is mounted to the interior side 118 of the exterior most door. In a biparting single-track door arrangement, the door guide assembly 116 sandwiches the door to which it is secured. Each door guide assembly 114, 116 is comprised of two flared members 120, 122 which are designed to receive the approaching door and, if it is slightly out of alignment, to bring it into alignment by the approaching door being received within the flared ends 124, 126 of the members 120, 122. As the members 120, 122 converge into a parallel position with respect to each other, the doors are brought into alignment.

Figure 7:
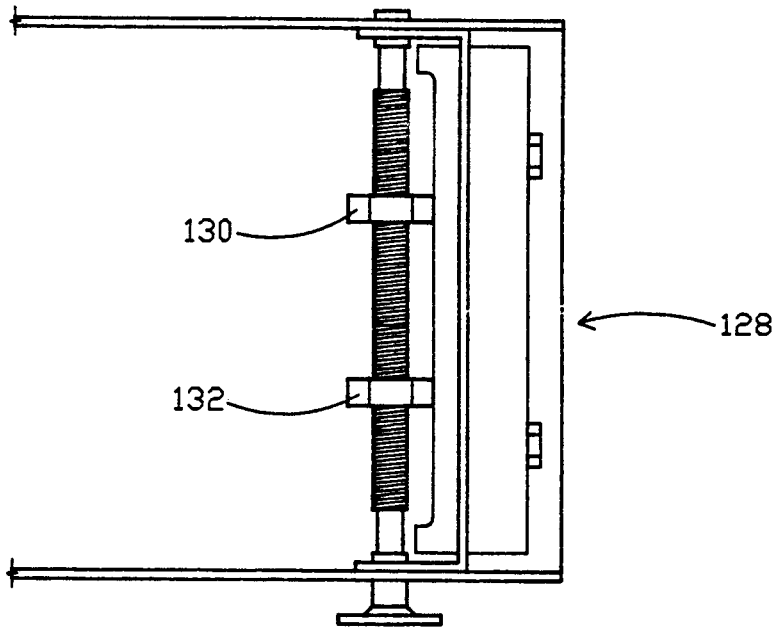
FIG. 7 is a plan view of a chain travel adjustment device which forms a part of the motorized unit.
Figure 14:
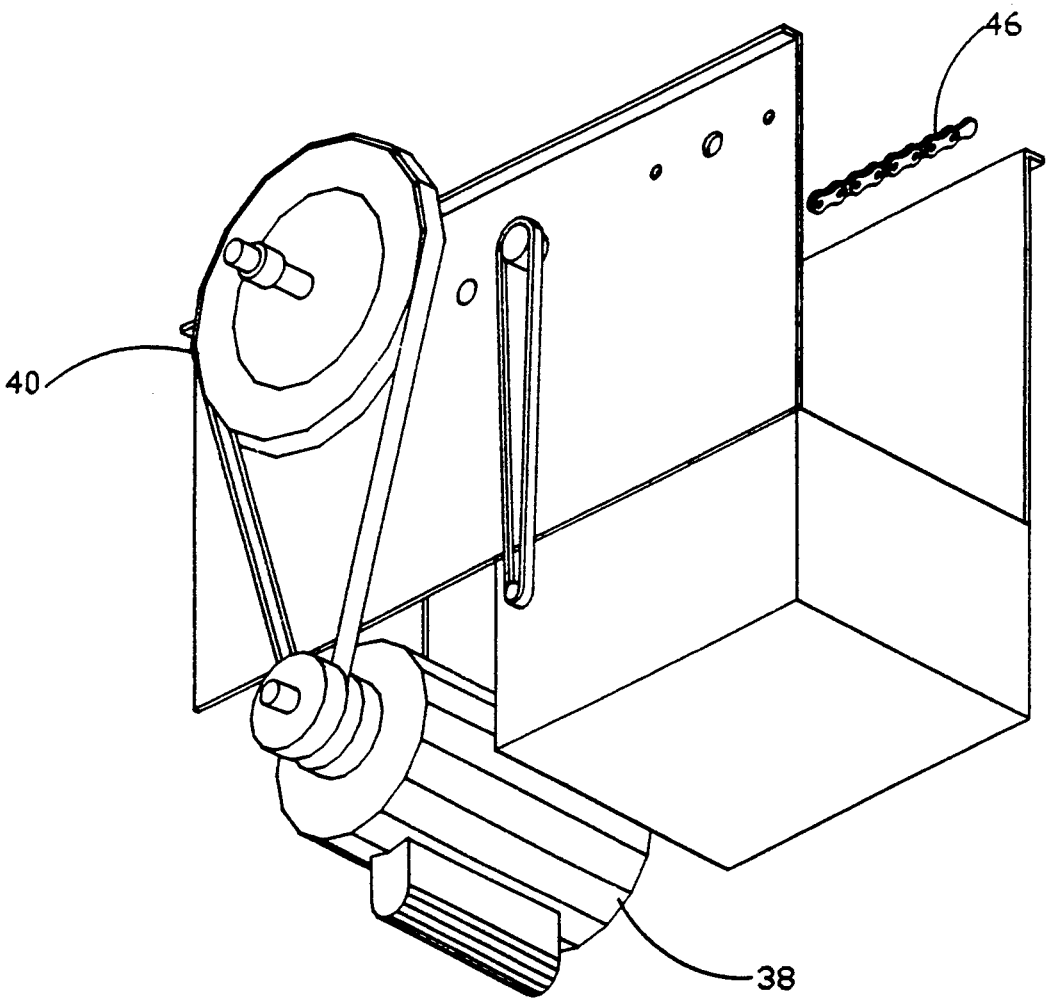
FIG. 14 is a perspective view of the motorized unit with gear drive for use with the present invention.

FIG. 14 shows a motorized unit 38 with gear drive 40 for use in the present invention. These devices are well known to those of ordinary skill in the art and will vary in size and horsepower depending upon the weight of the door(s) that must be operated. The motorized units, complete with gear drives, can be purchased from manufacturers such as Chamberlain Group in Chicago, Illinois. The chain drive means occurring within the motorized unit and gear drive assemblies will not be described herein because it is a function of the manufacturer of the motorized unit, and the present invention does not require alteration to this previously assembled device. In FIG. 7 an adjustment mechanism 128 is shown for use with the motorized unit 38 that controls the amount of travel the chain 46 will undertake when opening and closing a given door. This amount of chain travel can be adjusted by a close-limit nut 130 and open-limit nut 132 of the adjusting mechanism 128. The actual adjustment in a particular installation is a function of the doorway opening width.

The automatic door operator of the present invention and many of its attendant advantages will be understood from the foregoing description. It will be apparent that various changes may be made in the form and construction of the components of the invention without departing from the spirit and scope of the invention or sacrificing all of its material advantages.

What is claimed is:

1. An automatic door operator assembly for use in opening and closing a door slideably mounted to a building structure and movable along a path adjacent a doorway of said structure, the doorway defining an area inside said building structure and an area outside said building structure, said operator assembly comprising:

a motorized unit secured on a first side of said doorway and inside said building structure;

a gear drive driven by said motorized unit;

said door mounted on the outside of said building structure and at least one structural member rigidly secured to said door;

an idler bracket assembly secured to a second side of said doorway opposite said first side of said doorway and inside said building structure; and a flexible member forming a continuous loop, said flexible member in association with said gear drive, said structural member, and said idler bracket assembly, such that said flexible member actuated by said gear drive engages said structural member causing said door to open or close depending upon the direction of movement of said flexible member.

2. The assembly of claim 1, wherein said flexible member is a chain comprised of a plurality of links.

3. The apparatus of claim 1, wherein said idler bracket assembly comprises a freely revolving sprocket wheel.

4. An automatic door operator apparatus for use in opening two biparting doors slideable mounted on a building structure adjacent a doorway of said structure, said apparatus comprising:

a motorized gear drive unit mounted on a first side of said doorway, adjacent one of said doors, and inside said building structure;

a first structural member rigidly secured to a first door, said first door mounted on the outside of said building structure;

a second structural member rigidly secured to a second door, said second door mounted on the outside of said building structure;

an idler bracket assembly secured to a second side of said doorway opposite said first side of said doorway, and inside said building structure; and a flexible member forming a continuous loop, said flexible member driven by said motorized gear drive, said flexible member disposed in relation to said first structural member, said second structural member, and said idler bracket assembly, independent of door supporting means in such a way that as said flexible member moves in one direction, said first and second doors open simultaneously and when said flexible member moves in an opposite direction, said first and second doors simultaneously close.

5. An automatic door operator system for use in opening and closing first and second biparting doors slideably mounted to a building structure and movable along a path adjacent a doorway of said structure, said system comprising:

a drive unit mounted on a first side of said doorway adjacent said first door, and inside said building structure;

a first structural member rigidly secured to said first door, said first door mounted on the outside of said building structure;

a second structural member rigidly secured to a second door, a portion of said second door overlapping said first door when said doors are in a closed position, said second door mounted on the outside of said building structure;

an idler secured to a second side of said doorway adjacent said second door, and inside said building structure; and a flexible member formed in a continuous loop, extending from said drive unit to said idler, said flexible member driven by said drive unit engaging said first structural member and said second structural member to move said first and second doors when said drive unit is actuated.

6. In a building structure having a doorway and at least one horizontally sliding door mounted outside said building structure adjacent said doorway, an improved method for opening said slidable door, said method comprising the steps of:

securing a powered drive unit adjacent said doorway and inside said building structure;

securing at least one structural member to said at least one door;

providing a flexible member to engage said drive unit and said structural member;

providing a return device spaced apart from said drive unit and engaged by said flexible member, to enable said flexible member to form a continuous loop between said drive unit, said structural member, and said return device; and actuating said flexible member with said drive unit to cause said door to open.

* * * * *